United States Patent [19]

Johnson et al.

[11] 4,018,654

[45] Apr. 19, 1977

[54] PRETREATMENT OF COAL DURING TRANSPORT

[75] Inventors: Glenn E. Johnson, Pittsburgh; Harry B. Neilson, Clairton; Albert J. Forney, Coraopolis; William P. Haynes, Pittsburgh, all of Pa.

[73] Assignee: The United States of America as represented by the United States Energy Research and Development Administration, Washington, D.C.

[22] Filed: Sept. 5, 1974

[21] Appl. No.: 503,537

[52] U.S. Cl. ..... 201/9; 48/210

[51] Int. Cl.[2] ..... C10B 57/08; C10L 9/00

[58] Field of Search ..... 48/202, 203, 206, 210; 201/9

[56] References Cited

UNITED STATES PATENTS

| | | | |
|---|---|---|---|
| 2,577,632 | 12/1951 | Roetheli | 48/203 |
| 2,805,189 | 9/1957 | Williams | 201/9 |
| 3,337,417 | 8/1967 | Albright | 201/9 |
| 3,444,046 | 5/1969 | Harlow | 201/9 X |
| 3,884,649 | 5/1975 | Matthews | 201/9 X |
| 3,927,996 | 12/1975 | Knadsen | 48/202 X |

*Primary Examiner*—Morris O. Wolk
*Assistant Examiner*—Michael S. Marcus
*Attorney, Agent, or Firm*—Dean E. Carlson; Arthur A. Churm; Hugh Glenn

[57] ABSTRACT

Many available coals are "caking coals" which possess the undesirable characteristic of fusing into a solid mass when heated through their plastic temperature range (about 400° C.) which temperature range is involved in many common treatment processes such as gasification, hydrogenation, carbonization and the like. Unless the caking properties are first destroyed, the coal cannot be satisfactorily used in such processes. A process is disclosed herein for decaking finely divided coal during its transport to the treating zone by propelling the coal entrained in an oyxgen-containing gas through a heated transport pipe whereby the separate transport and decaking steps of the prior art are combined into a single step.

1 Claim, 4 Drawing Figures

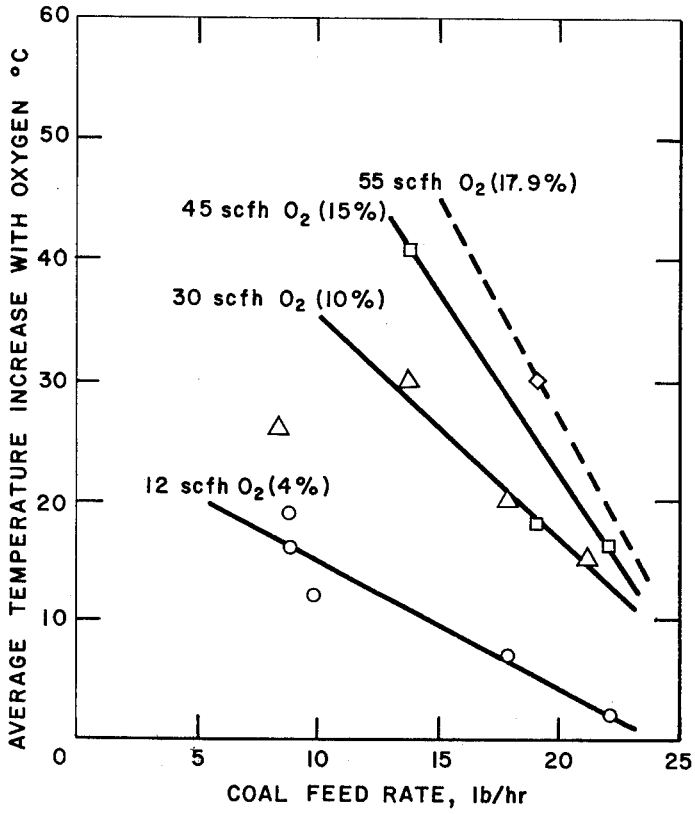
FIG. 1
FIG. 2
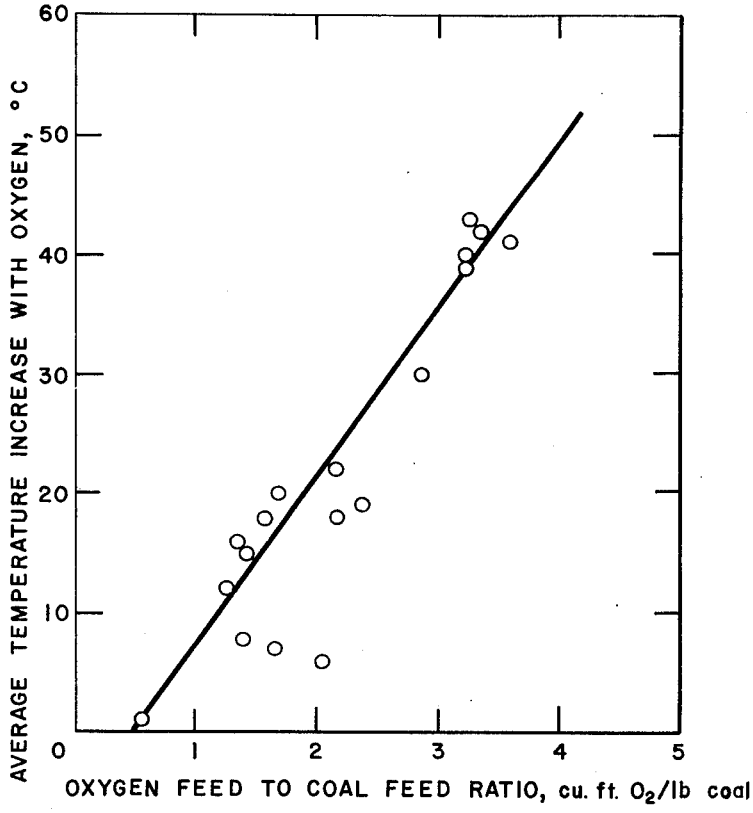

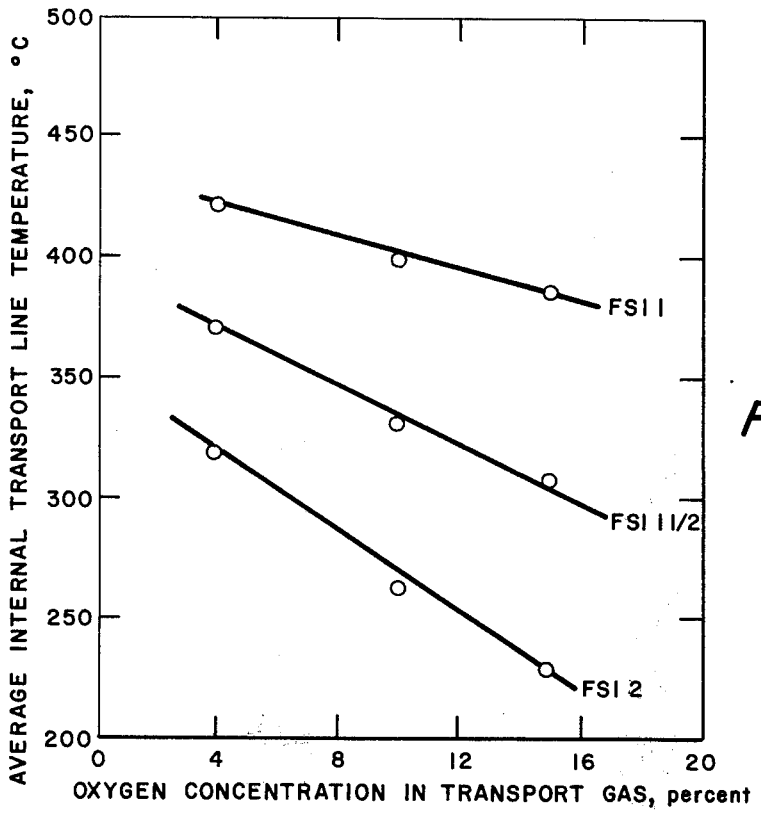
FIG. 3
FIG. 4
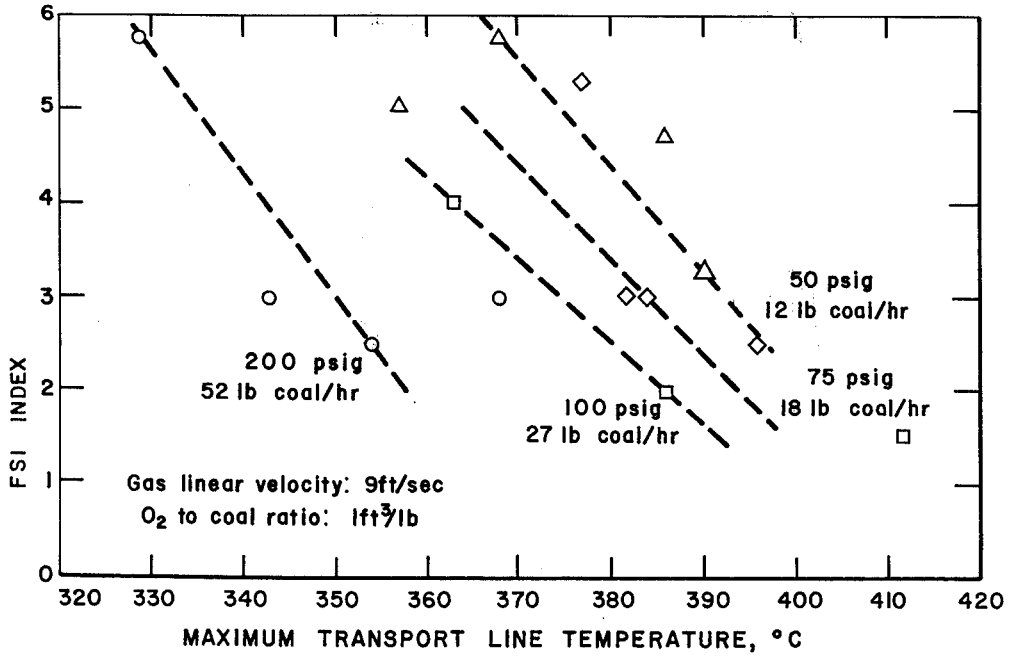

PRETREATMENT OF COAL DURING TRANSPORT

BACKGROUND OF THE INVENTION

It is recognized in the art that many of the available coals are "caking coals", that is, they possess the undesirable characteristic of fusing into a solid mass when heated through their plastic temperature range which occurs at about 400° C. This fusing or caking requires a pretreatment step to reduce or eliminate the caking property before the coal can be treated in gasification, hydrogenation, carbonization, and similar processes which require heating the coal through its plastic temperature range. The prior art recognizes a number of methods for pretreating coal to effect decaking.

The increased use of coal rather than petroleum as a source material makes it desirable that the processing of coal be made as efficient as possible in terms of time, cost and energy requirements. The method of this invention provides such an efficient means for decaking normally caking coals.

DESCRIPTION OF THE PRIOR ART

U.S. Pat. No. 3,355,363 relates to the decaking of a caking coal in a fixed bed by heating the coal in an atmosphere of an inert gas which contains a small amount of oxygen for long periods of time, e.g. 3 hours.

U.S. Pat. No. 3,357,896 teaches decaking of caking coals by preheating the caking coal to its softening point and allowing the preheated coal to fall through a zone containing an inert gas and a small amount of oxygen.

U.S. Pat. No. 3,463,623 also related to a process for decaking coal by free-fall through a pretreatment zone in the presence of oxygen.

BRIEF SUMMARY OF THE INVENTION

This invention relates to the pretreatment of carbonaceous material which has the property of caking or agglomerating when heated through its plastic temperature range. In particular, this invention relates to the treatment of caking coals to eliminate the caking property so that the coal can be subjected to conventional treating processes such as gasification, hydrogenation or carbonization in which caking temperatures (about 400° C and above) are often encountered.

Specifically, the process of this invention involves combining the step of transporting a caking carbonaceous material, particularly coal, and the step of decaking the coal. This is accomplished by entraining the coal in a finely divided state in an oxygen-containing gas and passing the gas-entrained coal through a heated pipe, or the like, to the treating zone where gasification, hydrogenation, carbonization or other desired treating step is effected.

DETAILED DESCRIPTION OF THE INVENTION

The various parameters involved in the process of this invention such as the particle size of the coal, the nature of the transporting gas, the time of residence in the heated passage, the proportion of oxygen, the temperature of the heated passage, the coal feed rate, and the like are variable over a wide range, and are highly interdependent. However, three essential conditions must be satisfied.

First, the process must be conducted below the plastic temperature range of the caking coal. Normally, the plastic temperature range occurs in temperatures of 400° C. and above. Accordingly, heating of the coal in the combined pretreatment-transporting step of this invention is conducted at temperatures up to about 425° C and below the caking temperature of the particular coal utilized.

Second, the particle size of the coal, the velocity of the gas in which the coal is entrained, the ratio of gas to coal and other related factors must be selected so that the coal is kept in transport and does not settle out in the heated passage which is normally simply a heated pipe.

Third, the amount of oxygen, the ratio of entraining gas to coal, the residence time, temperatures and other parameters must be sufficient to effect decaking of the coal.

The process has been successfully conducted with Pittsburgh seam coals ranging in particle size from 70% minus 200 mesh to 20 to 0 mesh (average particle size of about 235 microns) in feed rates of up to 100 lb/hr through 76.5 ft of ½ in. pipe. It is evident that the process can be conducted with coals having a smaller particle size and larger particle sizes can be accommodated in a larger pipe with appropriate changes in the entraining gas. Thus, coals having a particle size from about 50 microns to 250 microns are considered operative in a ½ inch heated pipe but larger or smaller particle sizes are not excluded. Similarly, all of the operating parameters discussed below can be varied from the ranges found useful in a ½ inch pipe so long as the three conditions set forth above are satisfied. Indeed, changes in pipe size may require considerable changes in other operating conditions.

Linear velocities of the entraining gas up to 15 ft/sec have been used successfully in the practice of this invention. Useful gas velocities generally fall in the range of 3 to 15 ft/sec. As mentioned above, the gas velocity is selected to achieve transport of the coal without settling and to give a suitable residence time.

The temperature of heating required to effect reaction between the oxygen and the coal, generally falls in the range of about 300°–425° C. The temperature required is a function of many factors such as the type of coal, its size and feed rate, oxygen concentration, gas pressure, and residence time. Also, it is believed that the coal must be heated to a certain minimum temperature before it reacts with oxygen. Once that temperature is achieved, a highly exothermic reaction takes place and therefore, it is postulated that the reaction occurs in a relatively short span of the transport pipe. In any case, the temperature selected must be sufficient to raise the coal and oxygen to the minimum temperature reaction which appears to occur at about 350° C under the conditions utilized in the following examples.

The ratio of oxygen to coal is highly dependent upon the particle size. The finer the coal particle, the more surface area is exposed and the less oxygen is required. Conversely, the larger the size of the coal particles the more oxygen is required. Successful results have been obtained with oxygen to coal ratios as low as about 0.5 $ft^3/lb$ on 70% minus 200 mesh coal. In any case, an FSI (Free Swelling Index) of 2 or below, should be achieved in accordance with the accepted standard for the process to be considered effective.

The pressure of the gas in the transport line can range widely. For example, pressures in the range of 100 psig to 600 psig have been used. It does not appear however that the pressure is critical and therefore, pressures outside of the 100 psig to 600 psig, particularly lower pressures are contemplated.

Residence time is measured by assuming that the coal is traveling at the same speed as the gas in which it is entrained. Measured in this way, residence times of 5 to 15 seconds have been used. However, residence times as low as one or two seconds would be sufficient if the minimum temperature for achieving the exothermic reaction between oxygen and the coal is achieved.

The entrainment gas, as explained above, comprises oxygen and an inert gas. The inert gas can be any gas which does not react under the conditions of transport or any gas which does not undesirably react under those conditions. Among the operable inert gases which may be mentioned are steam, carbon dioxide and nitrogen.

The entrainment gas, it is to be emphasized, propels the coal and is traveling in the same direction as the coal. Thus, the step of transporting the coal in the entraining gas is to be distinguished from treatment of coal with a countercurrent of gas and those processes in which the coal is transported by gravity.

BRIEF DESCRIPTION OF THE DRAWINGS

The relationship between various operating parameters have been investigated. The drawings depict several of these relationships in graphical form.

FIG. 1 shows the relationship between temperature increase in the transport line due to oxygen content at various coal feed rates.

FIG. 2 depicts the relationship between the increase in the transport line temperature and the oxygen feed to coal feed ratio.

FIG. 3 relates the effect of oxygen concentration and temperature on FSI (free swelling index).

FIG. 4 depicts the relationships between transport line temperature and FSI (free swelling index) at various pressures and coal feed rates.

DETAILED DESCRIPTION OF THE DRAWINGS

The data in the drawings is derived from tests conducted in a pretreater which is a ½-inch, schedule-40, 304-type stainless steel pipe, 76.5 feet in length. In FIGURES 1–3, size 20 × 0 mesh Illinois No. 6 coal was used at a transport line pressure of 8 atm. and at a linear velocity of 10 ft/sec. In FIG. 4 the pretreater was the same but the coal was size 20 × 0 Pittsburgh seam coal.

FIG. 1 illustrates the transport line temperature increase caused by the reaction of coal and oxygen at varying feed rates. The temperature increases are obtained by averaging the internal and external transport line temperatures with no oxygen flowing and again with oxygen being fed, the differences being the increases plotted in the graphs. The average lined out temperatures obtained without oxygen flow for the given coal-feed rates were as follows: 8 lb coal/hr, 310° C; 14 lb coal/hr, 280° C; 20 lb coal/hr, 254° C. Predictably, at a fixed oxygen rate, higher coal feed rates result in lower temperature increases (due to the cooling effect of the coal) and at a fixed coal rate, higher oxygen concentrations result in greater temperature increases. At a coal feed rate of 19 lb/hr, each cu. ft. of oxygen causes a temperature increase of about 0.5° C.

FIG. 2 presents similar data to FIG. 1, except that the oxygen and coal feed rates are shown as ratios. Maximum increases of temperature of about 43° C were obtained at the higher oxygen-to-coal ratios (>3 $ft^3$/lb).

FIG. 3 graphs the effects of oxygen concentration and transport line temperature on FSI. Coal feed rates ranged from 8 to 20 lb/hr. As expected, the higher the oxygen concentration, the lower the temperature required to pretreat the coal. At 4% oxygen, a temperature of 425° C is required to lower the FSI of the Illinois No. 6 coal to 1; 400° C accomplishes this with 10% oxygen and 15% oxygen requires only 385° C to lower the FSI to 1. Extrapolating the data in FIG. 3 indicates that with 1% oxygen in the feed gas, a temperature of about 450° C would give a FSI of less than 1 with Illinois No. 6 coal.

FIG. 4 is a plot of the FSI values as a function of maximum transport line temperatures at different pressures. Although the points are scattered and do not align very well, FIG. 4, in general, indicates that increased pressure favors pretreating; the same FSI values are obtained at lower temperatures with increased pressures. Or conversely, at identical temperatures lower FSI values are obtained with increased pressure.

EXAMPLES

The following Examples 1–19 illustrate the process of this invention.

A coal feed hopper having a capacity of about 300 lbs. coal is suspended by a meat-hook type scale which gives a continuous weighing of the coal in the feeder. Coal is fed at rates up to 80 lbs/hr by a mechanical coal feeder into the transport reactor line. The ½-inch, schedule 40, 304-type stainless steel reactor line is 76.5 feet long. The last 20 feet of the ½-inch reactor line is vertically oriented so that the char and gas disengage at the outlet of the ½ inch tube with the char falling into the char receiver. The $N_2$ and oxygen inlet gases are fed from cylinders and enter the transport line before the coal entry.

The temperatures of the entire length of the transport line is controlled by electrical heaters and is continuously measured by thermocouples along the length of the line.

Pittsburgh seam coal having a particle size of 70% minus 20 mesh was fed into the transport line maintained at a pressure of 7.5 atm. Thermocouples located at the following distances from the transport line inlet were used to record the internal temperature in the transport line:

No. 1 — 10 ft; No. 2 — 17 ft; No. 3 — 25 ft; No. 4 — 32 ft; and No. 5 — 52 ft.

The raw coal in Examples 1-10 had an FSI of 8 and the raw coal in Examples 11–19 had an FSI of 9. The final FSI and relevant conditions are summarized in Table I below. An FSI of "NC" means that the treated coal is non-caking.

TABLE I

| Ex | $N_2$ Feed, scfh | $O_2$ Feed, scfh | Glas Flows $O_2$ cu ft per lb. of coal | Product Gas, scfh | Linear Velocity, ft/sec | Coal Feed Rates, (actual) lb/hr | Temperatures, Internal ° C 1 | 2 | 3 | 4 | 5 | FSI |
|---|---|---|---|---|---|---|---|---|---|---|---|---|
| 1 | 106 | 4.8 | 0.35 | 109 | 4.19 | 13.6 | 275 | 370 | 405 | 351 | 322 | 2.5 |

TABLE I-continued

| Ex | $N_2$ Feed, scfh | $O_2$ Feed, scfh | Glas Flows $O_2$ cu ft per lb. of coal | Product Gas, scfh | Linear Velocity, ft/sec | Coal Feed Rates, (actual) lb/hr | Temperatures, Internal ° C 1 | 2 | 3 | 4 | 5 | FSI |
|---|---|---|---|---|---|---|---|---|---|---|---|---|
| 2 | 106 | 6.0 | .44 | 110 | 4.19 | 13.6 | 290 | 350 | 384 | 347 | 318 | NC |
| 3 | 108 | 3.5 | .26 | 112 | 4.33 | 13.6 | 305 | 382 | 383 | 343 | 307 | 3 |
| 4 | 108 | 5.4 | .40 | 112 | 4.43 | 13.6 | 343 | 385 | 408 | 353 | 325 | 2 |
| 5 | 109 | 7.2 | .53 | 109 | 4.34 | 13.6 | 300 | 413 | 425 | 364 | 330 | NC |
| 6 | 108 | 5.6 | .7 | 113 | 4.42 | 8.0 | 325 | 360 | 368 | 338 | 315 | NC |
| 7 | 168 | 5.6 | .64 | 169 | 6.51 | 8.7 | 312 | 346 | 370 | 327 | 338 | NC |
| 8 | 170 | 5.6 | .40 | 170 | 7.78 | 14.1 | 280 | 328 | 357 | 318 | 325 | 2 |
| 9 | 165 | 7.2 | .48 | 171 | 6.41 | 15.0 | 272 | 323 | 360 | 327 | 333 | 3 |
| 10 | 161 | 10.3 | .70 | 170 | 6.13 | 14.7 | 252 | 303 | 333 | 300 | 354 | NC |
| 11 | 108.6 | 10.2 | 0.97 | 114.8 | 4.42 | 10 | 290 | 347 | 333 | 300 | 308 | NC |
| 12 | 109.2 | 12.0 | 1.14 | 118.1 | 4.76 | 10 | 298 | 378 | 387 | 383 | 325 | NC |
| 13 | 109.7 | 13.4 | 1.28 | 118.1 | 4.58 | 10 | 268 | 348 | 410 | 360 | 325 | NC |
| 14 | 109.8 | 13.4 | 1.28 | 118.5 | 4.71 | 10 | 230 | 280 | 390 | 375 | 353 | NC |
| 15 | 107.9 | 7.2 | 0.76 | 114.0 | 4.50 | 10 | 300 | 343 | 370 | 330 | 315 | NC |
| 16 | 109.2 | 7.2 | 0.76 | 114.2 | 4.56 | 10 | 295 | 370 | 395 | 357 | 307 | NC |
| 17 | 108.4 | 7.2 | 0.76 | 115.2 | 4.65 | 10 | 325 | 387 | 375 | 337 | 325 | NC |
| 18 | 108.9 | 8.8 | 0.93 | 114.9 | 4.55 | 10 | 283 | 371 | 395 | 340 | 303 | NC |
| 19 | 108.6 | 10.2 | 1.08 | 116.8 | 4.74 | 10 | 300 | 387 | 425 | 351 | 305 | NC |

We claim:

1. In a process for decaking a caking coal including a pretreatment step to reduce its agglomerating properties while it is being transported to a treating zone for subsequent treatment the improvement within said pretreatment step comprising passing the coal having a particle size of 50 to 250 microns at a rate of 5 to 100 lb/hr entrained in nitrogen gas in mixture with 4 to 15% by weight oxygen at a flow rate sufficient to provide at least 0.2 ft of oxygen per pound of coal, heating said cool entrained within said nitrogen-oxygen mixture in a passage of about ½ inch diameter to a temperature of 300° to 425° C but below the caking temperature of said coal, at a pressure of 100 psig to 600 psig for a residence time of the coal in the heated passage of 1 to 15 seconds; whereby a FSI of 2 or below is achieved.

* * * * *